US009490089B2

(12) United States Patent
Gentsch et al.

(10) Patent No.: US 9,490,089 B2
(45) Date of Patent: Nov. 8, 2016

(54) SHIELDING ELEMENT FOR THE USE IN MEDIUM VOLTAGE SWITCHGEARS

(71) Applicant: ABB Technology AG, Zürich (CH)

(72) Inventors: Dietmar Gentsch, Ratingen (DE); Wenkai Shang, Ratingen (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/444,548

(22) Filed: Jul. 28, 2014

(65) Prior Publication Data

US 2014/0332501 A1 Nov. 13, 2014

Related U.S. Application Data

(63) Continuation of application No. PCT/EP2013/000213, filed on Jan. 24, 2013.

(30) Foreign Application Priority Data

Jan. 26, 2012 (EP) ..... 12000484

(51) Int. Cl.
*H01H 33/662* (2006.01)

(52) U.S. Cl.
CPC ..... *H01H 33/66261* (2013.01); *H01H 2033/66269* (2013.01)

(58) Field of Classification Search
CPC ..... H01H 33/66; H01H 33/662; H01H 33/66261
USPC ..... 218/136, 131, 147, 150, 151
See application file for complete search history.

(56) References Cited

U.S. PATENT DOCUMENTS

| | | | | |
|---|---|---|---|---|
| 3,720,798 | A * | 3/1973 | Kabayama et al. | 218/136 |
| 4,331,850 | A * | 5/1982 | Lipperts | 218/131 |
| 2008/0203063 | A1* | 8/2008 | Dullni et al. | 218/136 |

FOREIGN PATENT DOCUMENTS

| | | | |
|---|---|---|---|
| DE | 195 03 347 | A1 | 8/1996 |
| GB | 1126083 | A1 | 9/1968 |

(Continued)

OTHER PUBLICATIONS

Machine translation of JP2001351485 (Orig. doc. published Dec. 21, 2001).*

(Continued)

*Primary Examiner* — Renee S Luebke
*Assistant Examiner* — William Bolton
(74) *Attorney, Agent, or Firm* — Taft Stettinius & Hollister LLP

(57) ABSTRACT

A shielding element is disclosed for use in medium voltage switchgears with vacuum interrupters with at least two contacts, which are movable along a switching path between closed and open contact positions, wherein the shielding element is positioned around the contact position region in the vacuum interrupter, wherein at least the inner surface of the shielding is applied with an implemented surface structure to form a topographic structure which is a rough or a structured surface. To enhance the energy absorbance behavior of the shielding, the implemented topographic structure can be formed such that by given constant or approximately constant volume (Vi) of the shielding body, the surface ratio of the treated surface (S2) with implemented surface structure and volume V2, and a untreated surface (S1) without topographic structure and volume V1 is greater than 1, so that this follows the condition: V1~V2 and S2/S1>1.

8 Claims, 1 Drawing Sheet

(56) References Cited

FOREIGN PATENT DOCUMENTS

| | | | |
|---|---|---|---|
| JP | 3-261020 | A | 11/1991 |
| JP | 2001-351485 | A | 12/2001 |

OTHER PUBLICATIONS

Machine translation of DE19503347 (Orig.doc. published Aug. 8, 1996).*

International Search Report (PCT/ISA/210) mailed on May 7, 2013, by the European Patent Office as the International Searching Authority for International Application No. PCT/EP2013/000213.

Written Opinion (PCT/ISA/237) mailed on May 7, 2013, by the European Patent Office as the International Searching Authority for International Application No. PCT/EP2013/000213.

Search Report mailed on Jun. 27, 2012, by the European Patent Office for Application No. 12000484.1.

* cited by examiner

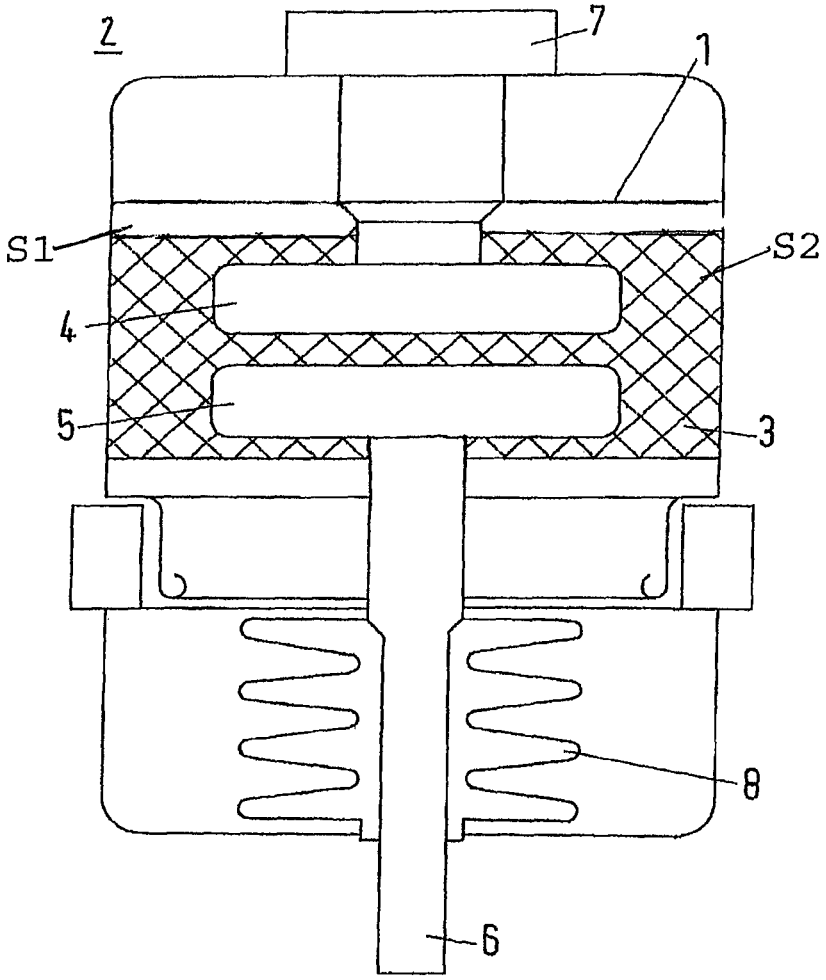
2
7
1
S1
S2
4
5
3
8
6

SHIELDING ELEMENT FOR THE USE IN MEDIUM VOLTAGE SWITCHGEARS

RELATED APPLICATIONS(S)

This application claims priority as a continuation application under 35 U.S.C. §120 to PCT/EP2013/000213, which was filed as an International Application on Jan. 24, 2013 designating the U.S., and which claims priority to European Application 12000484.1 filed in Europe on Jan. 26, 2012. The entire contents of these applications are hereby incorporated by reference in their entireties.

FIELD

The present disclosure relates to a shielding element for the use in medium voltage switchgears with vacuum interrupters with at least two contacts, which are movable along a switching path between closed and open contact positions, wherein the shielding element is positioned around the contact position region in the vacuum interrupter.

BACKGROUND INFORMATION

Vacuum interrupters are in use with inner shielding elements surrounding the contact position in closed and opened positions.

By using profiled shielding for vacuum interrupters, it is possible to absorb more metal vapour for vacuum interrupters during switching, and therefore increase the interrupting capability as known from the DE 19503347 A1.

It is known that when a profiled shielding is used, then the profile is tangential to the axial direction of the shielding and is made by machining as mentioned in DE 19503347 A1. Because the profile is tangential to the shielding, the production method can only use machining, The wall thickness for the shielding has to be thick, in order to provide enough bulk material to get a profiled shielding after machining.

SUMMARY

A shielding element is disclosed for medium voltage switchgears with vacuum interrupters with at least two contacts, which are movable along a switching path between closed and open contact positions, wherein the shielding element comprises: a shielding body configuration for positioning around a contact position region in a vacuum interrupter, the shielding element having an inner surface with a topographic structure which is a rough or a structured surface, wherein the topographic structure is formed such that by constant or approximately constant volume (Vi) of the shielding body, a surface ratio of a treated surface (S2) with an implemented surface structure and of volume V2, and an untreated surface (S1) without topographic structure and of volume V1, is greater than 1, according to a condition: V1~V2 and S2/S1>1.

BRIEF DESCRIPTION OF THE DRAWINGS

Other features and advantages will become apparent from the following detailed description when read in conjunction with the accompanying drawing, wherein:

FIG. 1 shows an exemplary shielding element as disclosed herein.

DETAILED DESCRIPTION

The present disclosure relates to enhancing an energy absorbance behavior of a shielding.

An exemplary implemented topographic structure is formed in such a way that by a given constant or approximately constant volume (Vi) of the shielding body, the surface ratio of the treated surface (S2) with an implemented surface structure and of volume V2, and an untreated surface (S1) without topographic structure, and of volume V1, is greater than 1, so that this follows the condition:

$$V1 \sim V2 \text{ and } S2/S1 > 1.$$

This condition can provide an advantage in the manufacture as well as in a constant high performance of such shieldings and vacuum interrupters in serial manufacture of vacuum interrupters and shieldings for different measures and ampacities.

In exemplary embodiment, a volume of the shielding itself is addressed, which is not the volume which can be enclosed as a cylinderic room surrounded by the shielding. The volume, mentioned herein, can be the material volume of the shielding itself. So V1 is the volume of the shielding with an untreated flat inner surface, and V2 is the volume of the shielding, with a treated structured inner surface.

A partly disordered surface means in this sense, that the implemented structures are not mainly one-direction orientented structures. By that, a maximum for microscopic surface multiplication can be achieved, which can have maximum possible energy absorption in case of occuring light arcing.

An exemplary embodiment for such a topography with high energy absorption is given in that the topographic surface structure is a blasted surface treated by abrasive particle blasting. This surface is rough, with the aforesaid high effective surface multiplication, and can be manufactured very easily with a high reproductive quality.

A further exemplary embodiment is given by a topographic structure which can include (e.g., consist of) crosswise arranged grooves, so called knurl-structures. This structure is regular oriented, but it is not aligned in relation to the long axis or any other orientation. This kind of very special topography can be used for structuring a surface to get a simplified machine implementation which can be used for the enhancement of the energy absorption of light arc energy, which occurs inside the vacuum interrupter.

The knurling can have a great surface multiplying factor, so that energy can be absorbed by greater surface.

In an exemplary embodiment, the topographic structure is implemented by machining. This is easy to manufacture.

Furthermore, each contact can be mounted on a stem, and at least partial regions near to the contact piece can be additionally applied with topographic surface structures, in order to absorb energy from light arc occurance.

The threaded shield can have a depth defined in wide range. In cases where the material is copper or copper chromium, the molten metal comes from the contact system during arcing under a short circuit condition and sticks at the surface. The chopper or copper-chormium is wetting the surface of the shielding material. That means the material stays at the surface with good bounding condition.

In exemplary embodiments using steel material or stainless steel material, it can happen that the wetting of the copper-chromium material (release of molten contact material) sticks—not—in a proper way at the shield surface. There can occur a spike coming from the threaded area of each winding of the thread. In such cases, the dielectric performance can be reduced.

The "knurl" structure design can provide a desired surface area increase (compare therefore the attached sketch and the picture of how the knurl design appear) without the drawback that a "long" spike can be generated inside the winding of a threaded surface.

But also the blasted surface can be easy to manufacture in a highly reproductive constant quality remaining way.

FIG. 1 shows an exemplary embodiment in which at least the shielding 1 in a vacuum interrupter 2 is structured at least partly on its inner surface with a knurl-structure 3; that means, for example, a cross ligned alignment of grooves.

The knurl-structure 3 can be positioned at least near to the contact piece 4, 5 positions on the inner surface of the shielding.

Additionally also regions near the contact pieces 4 and 5, for example the region where the contact pieces are fixed with the stems 6 and 7, can have additionally such a knurl-structure, in order to absorb energy efficiently also in this region.

An exemplary alternative to the disclosed knurling surface structure is a blasted surface.

Blasted surfaces can be applied on the inner surface of the shielding, but also in the aforesaid other regions, as described in cases of knurling surfaces.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

Position Numbers

1 Shielding
2 Vacuum interrupter
3 Surface structure (knurling, blasting)
4 Contact piece
5 Contact piece
6 Stem
7 Stem
8 Bellow

The invention claimed is:

1. A shielding element for medium voltage switchgears with vacuum interrupters with at least two contacts, which are movable along a switching path between closed and open contact positions, wherein the shielding element comprises:

a shielding body configuration for positioning around a contact position region in a vacuum interrupter, the shielding element having an inner surface with a topographic structure which is a rough at least partly disordered surface structure, wherein the topographic structure is formed such that by constant or approximately constant volume (Vi) of the shielding body, a surface ratio of a treated surface (S2) with an implemented surface structure and of volume V2, and an untreated surface (S1) without topographic structure and of volume V1, is greater than 1, according to a condition: V1~V2 and S2/S1 >1.

2. The shielding element according to claim 1, wherein implemented surface structure is a topographic surface structure which is a blasted surface treated by abrasive particle blasting.

3. The shielding element according to claim 2, in combination with a vacuum interrupter having at least two contacts mounted on a stem, and at least regions near to at least two contacts are applied with the topographic surface structures for absorbing energy from light arc occurance.

4. The shielding element according to claim 1, wherein implemented surface structure is a topographic structure which comprises:

crosswise arranged grooves from a knurl-structures.

5. The shielding element according to claim 4, in combination with a vacuum interrupter having at least two contacts mounted on a stem, and at least regions near to at least two contacts are applied with the topographic surface structures for absorbing energy from light arc occurance.

6. The shielding element according to claim 1, wherein the implemented surface structure is a topographic structure which is a machined element.

7. The shielding element according to claim 6, in combination with a vacuum interrupter having at least two contacts mounted on a stem, and at least regions near to at least two contacts are applied with the topographic surface structures for absorbing energy from light arc occurance.

8. The shielding element according to claim 1, in combination with a vacuum interrupter having at least two contacts mounted on a stem, and at least regions near to the at least two contacts are applied with the topographic surface structures for absorbing energy from light arc occurance.

* * * * *